United States Patent [19]

Howard

[11] Patent Number: 4,872,823

[45] Date of Patent: Oct. 10, 1989

[54] APPARATUS FOR FORMING A COLUMNAR REINFORCEMENT IN A CONCRETE WALL PANEL

[75] Inventor: Albert Howard, San Jose, Calif.

[73] Assignee: Clay Shanrock, Hollister, Calif. ; a part interest

[21] Appl. No.: 593,028

[22] Filed: Mar. 23, 1984

[51] Int. Cl.[4] ..... E04G 11/20

[52] U.S. Cl. ..... 425/64; 264/33; 404/98; 404/119; 425/219; 425/456

[58] Field of Search ..... 249/2, 8, 20; 425/62, 425/63, 64, 111, 219, 432, 456; 264/33, 34; 404/98, 118, 119

[56] References Cited

U.S. PATENT DOCUMENTS

| | | | |
|---|---|---|---|
| 2,187,223 | 1/1940 | Cory | 264/33 |
| 2,306,671 | 12/1942 | Tamblyn | 404/119 |
| 2,623,446 | 12/1952 | Clark et al. | 425/64 |
| 2,962,785 | 12/1960 | Young | 425/456 |
| 3,049,786 | 8/1962 | Jones | 25/118 |
| 3,363,524 | 1/1968 | Catenacci | 94/46 |
| 3,585,911 | 6/1971 | Vlasic | 404/98 |
| 3,600,773 | 8/1971 | Davis | 25/118 W |
| 3,681,484 | 8/1972 | McKie et al. | 425/456 |
| 3,954,359 | 5/1976 | Larkin | 425/63 |
| 4,027,990 | 6/1977 | Merrill | 404/98 |
| 4,115,976 | 9/1978 | Rohrer | 404/119 |
| 4,132,492 | 1/1979 | Jenkins | 404/119 |
| 4,199,541 | 4/1980 | McFarland | 404/98 |
| 4,397,580 | 8/1983 | Morrison | 404/72 |
| 4,397,626 | 8/1983 | Morrison | 425/456 |
| 4,437,828 | 3/1984 | Egger | 404/119 |
| 4,492,552 | 1/1985 | Murakami et al. | 425/111 |

*Primary Examiner*—James C. Housel

*Attorney, Agent, or Firm*—Jack M. Wiseman

[57] ABSTRACT

Apparatus for forming a concrete panel for constructing a wall of a building in which a reinforcing column of concrete is integrally formed therewith. The apparatus has a hopper in which cement is poured. Depending from the hopper is an inverted U-shaped channel member with depending walls for forming the column. Projecting outwardly from the bottom of the depending walls are flanges. Outboard of the flanges are runners which slide over rails for advancing the apparatus over a rectilinear path.

3 Claims, 1 Drawing Sheet

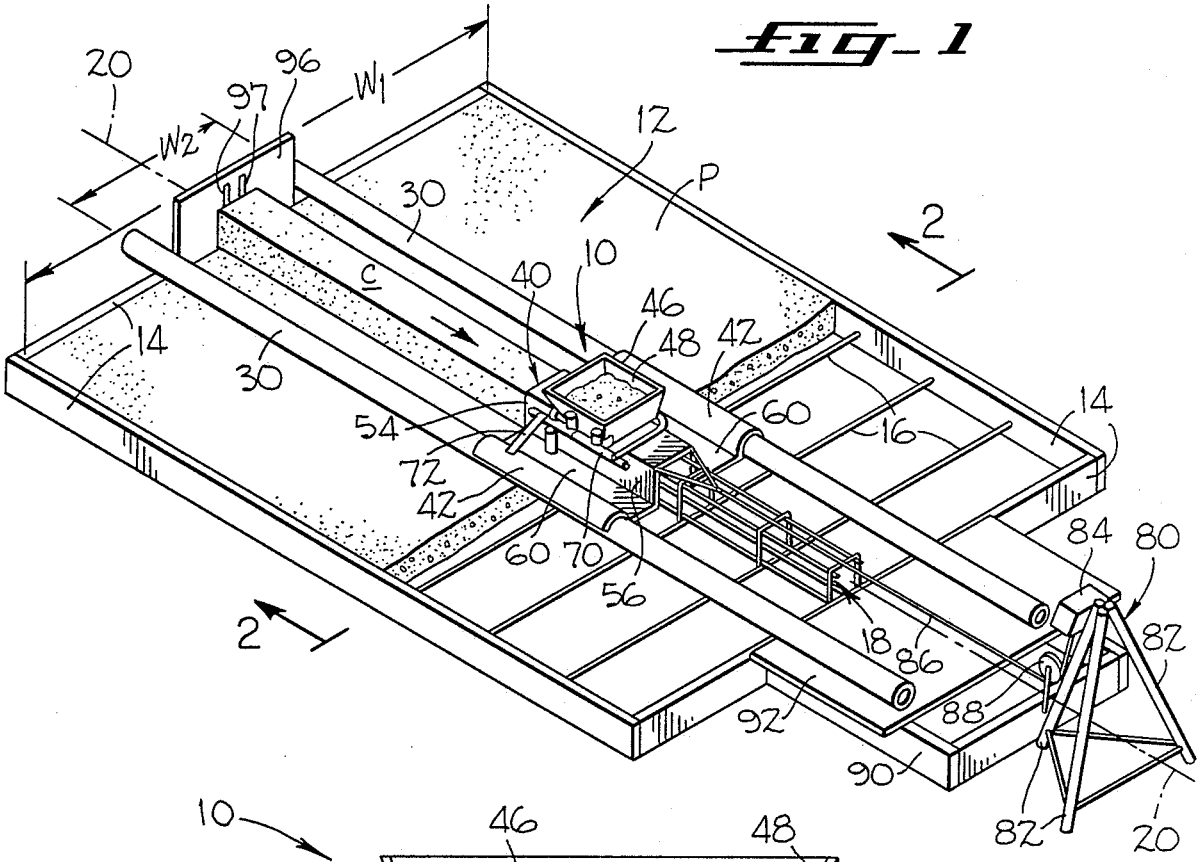
fig_1
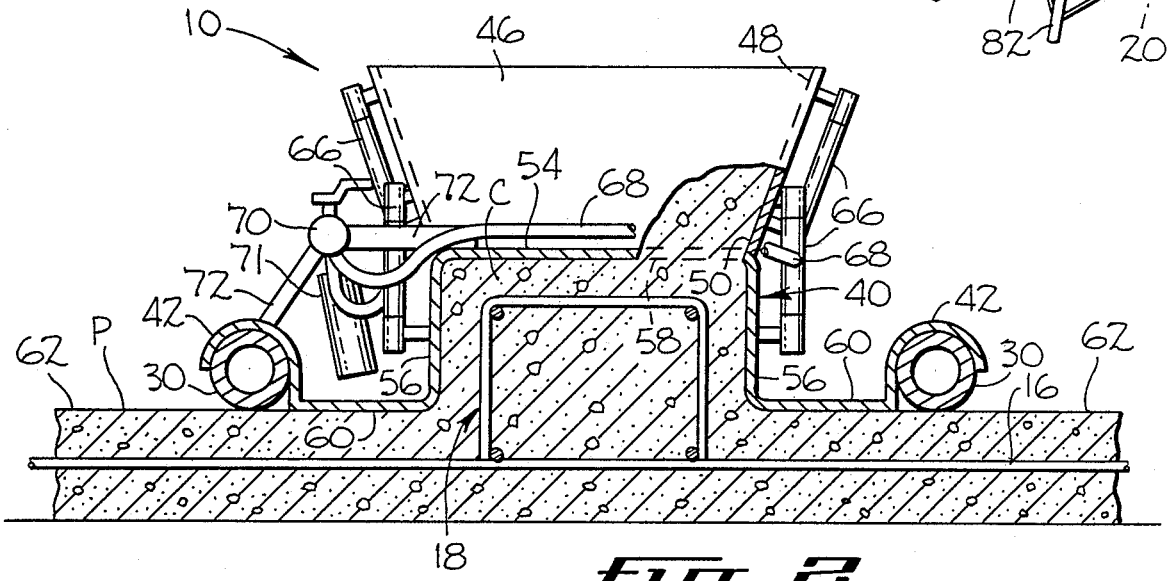
fig_2
fig_3
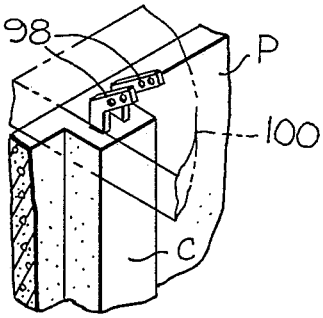
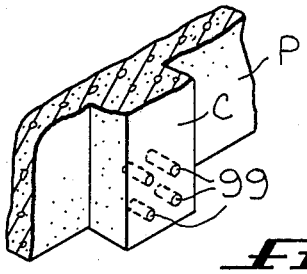
fig_4

APPARATUS FOR FORMING A COLUMNAR REINFORCEMENT IN A CONCRETE WALL PANEL

BACKGROUND OF THE INVENTION

The present invention relates in general to concrete forming apparatus, and more particularly to concrete forming apparatus for simultaneously forming a tilt-up panel for a wall of a building and a structural reinforcing column for such panel.

A widely used technique for constructing buildings from concrete involves fabricating numerous individual panels by pouring concrete into forms located on a flat, horizontal surface. After these individual concrete panels are cured or become hardened, they are then raised to a vertical position to form the outer walls of a building. In addition thereto, the walls generally include vertical columns having a greater cross-sectional thickness than that of the panel. The vertical columns are located at intervals along the wall to provide structural reinforcement for those panels located on each side of them.

Frequently, the vertical structural reinforcing columns are erected in place by first positioning concrete reinforcing material, such as steel reinforcing bars, vertically into the gap between the vertical edges of each pair of adjacent panels. This gap is then closed by erecting a pair of vertical forms. One form is disposed along the outer surface of the wall, thereby establishing a sealed cavity about the reinforcing material. Concrete is then poured into this cavity about the vertical lengths of reinforcing material. After the concrete cures about the reinforcing material, the forms are then removed leaving the completed vertical column filling the gap between the vertical edges of a pair of adjacent panels.

This method for constructing the structural reinforcing columns requires erecting the reinforcing material and the forms vertically prior to pouring the concrete, and then subsequently removing those forms after the concrete hardens. The construction of such a tilt-up wall would be faster and, hence, less expensive were it possible to form columns for a panel prior to raising the panel into its vertical position. However, a difficulty with forming reinforcing columns in a panel prior to raising it occurs in shaping concrete to form the thicker cross-sectional shape for the column. The thicker cross-section column will project upward from the surface of the panel prior to its being raised into its vertical position Since the column will be located about the center of a panel along its width rather than along one of its vertical edges, it is difficult to establish the shape of the column using fixed forms similar to those which generally surround the panel to establish its edges when it is initially poured.

The patent to Leland J. Davis, U.S. Pat. No. 3,600,773, issued on Aug. 24, 1971, for Concrete Forming Device, discloses a concrete forming device that produces simultaneously a curb and gutter in concrete on a continuous basis without the use of conventional forms. The device disclosed by the patent to Davis comprises a hopper in which concrete is poured. The hopper communicates with an inverted U-shaped mold to form a curb and gutter. A vibrator causes the concrete to fill the mold and a winch is used to move the hopper and the mold.

In the patent to Charles T. Merrill, U.S. Pat. No. 4,027,990, issued on June 7, 1977, for Adjustable Curber and Sidewalk Forming Machine, there is disclosed apparatus for making curbs and sidewalks. The apparatus comprises a hopper in which concrete is poured. The hopper has side walls to define a channel. At the bottom of the side walls are flanges which ride on form members. A vibrator is mounted on the hopper and a winch advances the hopper along the form.

In the patent to Jones, U.S. Pat. No. 3,049,786, issued on Aug. 21, 1962, for Apparatus For Making Prestressed Structural Members, there is disclosed apparatus for forming prestressed structural members, such as channel beams. The apparatus comprises a hopper, which communicates with an inverted U-shaped mold. The mold advances over prestressed rods to deposit concrete thereover in the formation of a channel beam. The concrete partially solidifies in the mold. The mold is moved along to form another section of the channel beam.

SUMMARY OF THE INVENTION

Apparatus for forming a concrete panel for constructing a wall of a building in which a reinforcing column of concrete is integrally formed therewith. The apparatus comprises a hopper in which cement is poured. Depending from the hopper is an inverted U-shaped channel member with depending walls for forming the column. Projecting outwardly from the bottom of the depending walls are flanges. Outboard of the flanges are runners which slide over rails for advancing the apparatus over a rectilinear path.

An object of the present invention is to provide an apparatus for and method of forming a columnar reinforcement in a concrete wall panel.

Another object of the present invention is to provide an apparatus for forming a columnar reinforcement along a wide concrete wall panel.

Another object of the present invention is to provide an apparatus for conveniently forming a columnar reinforcement at varied locations within a concrete wall panel.

Briefly, the apparatus of the present invention includes concrete shaping means for receiving concrete and shaping it to form a reinforcing column along a wall panel. The shaping means is supported above the space in which the panel is to be cast for rectilinear movement. Supporting the concrete shaping means above the casting space for rectilinear movement, in the preferred embodiment, are a pair of rails projecting along the casting space over which ride a pair of runners that are secured to the shaping means. The distance between the runners is less than the width of the panel. Consequently, the concrete forming apparatus of the present invention may be used to form reinforcing columns along panels of varied width and also to form reinforcing columns at various locations along the panel. Lastly, the apparatus includes means for advancing the concrete shaping means along the space in which the panel is to be cast. Thus, while concrete is deposited in the concrete shaping means to be formed into a reinforcing column, the shaping means may be advanced continuously along the space in which the panel is to be formed at a rate suitable for forming the reinforcing column.

An advantage of the present invention is that it provides an apparatus adapted for forming a columnar reinforcement in a concrete wall panel.

An advantage of the present invention is that it provides an apparatus adapted for forming a columnar reinforcement along a wide concrete wall panel.

An advantage of the present invention is that it provides an apparatus adapted for conveniently forming a columnar reinforcement at various locations within a concrete wall panel.

A method of forming a columnar reinforcement on a concrete wall panel in which the column is integrally formed with the wall panel. The concrete is poured simultaneously to form the wall panel and to form the column.

A method of forming a columnar reinforcement on a concrete wall panel in which the column forming apparatus is moved continuously over a rectilinear path above the casting area for the wall panel.

DESCRIPTION OF THE DRAWINGS

FIG. 1 is a diagrammatic perspective view of a concrete forming apparatus embodying the present invention illustrating it use for forming a columnar reinforcement in a concrete wall panel.

FIG. 2 is an enlarged, fragmentary, diagrammatic vertical cross-sectional view of the concrete forming apparatus of the present invention taken along line 2-2 of FIG. 1.

FIG. 3 is a fragmentary perspective view of glulam brackets embedded in the columnar reinforcement of a concrete wall and received by a structural member.

FIG. 4 is a fragmentary perspective view of concrete inserts embedded in the columnar reinforcement of a concrete wall.

DETAILED DESCRIPTION OF THE PREFERRED EMBODIMENT

FIG. 1 shows a concrete forming apparatus, referred to by the general reference number 10, incorporating the present invention. The apparatus 10 is supported above a rectangularly shaped casting space 12 having a width $W_1$ which is enclosed by perimeter forms 1 The forms 14 enclose steel reinforcing bars 16 placed within the casting space 12. A section of the reinforcing bars 16 establish box shaped section 18 which is disposed along a longitudinal line 2

The apparatus 10 of the present invention includes a pair of rails 30 secured at their ends to the upper surface of the forms to project along and above the casting space 12. The rails 30 ar disposed parallel to the longitudinal line 20 of the box shaped section 18. Further, the rails 30 are respectively located on opposite sides of the box shaped section 18 to occupy a space having a horizontal width $W_2$. The width $W_2$ is narrower than the width $W_1$ of the casting space 12.

The apparatus 10 of the present invention also includes concrete shaping means 40 supported above the casting space 12 by a pair of semi-cylindrical runners 42 (FIG. 2) which respectively engage the upper surface of the rails 30 for movement therealong. As shown in FIG. 2, the shaping means 40 includes a hopper 46 formed in the shape of a hollow, inverted, truncated pyramid with a larger aperture 48 occupying the entire area of its upper surface and a smaller aperture 50 occupying the entire area of its lower surface. Depending from the hopper 46 in fixed relation thereto is an inverted, U-shaped forming channel member 54 with downwardly depending walls 56. The forming channel member 54 has an aperture in its horizontal base surface communicating with the smaller aperture 50 of the hopper 46. A flange 60, to which one of the runners 42 attaches, projects outwardly from the lower extremity of each of the walls 56 and away from the interior of said U-shaped forming channel member 54 along a common planar surface 62.

The shaping means 40 further includes a plurality of hermetically sealed hydraulic cylinders 66 either secured by suitable brackets at both terminal ends to the hopper 46 or secured by suitable brackets at one terminal end to the hopper 46 and at the other terminal end to the forming channel member 54. A plurality of hoses 68 connect the individual hydraulic cylinders 66 to a manifold 70 for conducting oil under pressure therebetween. The manifold 70 receives oil under pressure from a suitable lubricator 71 to activate the hydraulic cylinders 66 for agitating the hopper 46 and the shaping means 40. The manifold 70 and the lubricator 71 are supported from the forming channel member 54 and one of the runners 42 by brackets 72. The lubricator 71 is of the type manufactured by Motion Industries, Inc. The agitating action of the cylinders 66 imparts the vibrating action to the hopper 46 and to the channel member 54. Any suitable vibrator may be employed equally as well, such as an Allen Engineering vibrator, AEC 1110.

Referring again to FIG. 1, the concrete forming apparatus 10 further includes a tripod 80 having three legs 82. A winch 84 is secured to one of the legs 82 near the apex of the tripod 80. A suitable winch is one manufactured by Dutton-Lainson as Model DL 1200. A cable 86 extends from the winch 84 and is trained around a pulley 88 along a path substantially parallel to the longitudinal line 20. The free end of the cable 86 is attached to the shaping means 40. Thus, by actuating the winch 84, the shaping means 40 is moved along the casting space 12 by a force applied thereto from the winch 84 through the cable 86. The tripod 80 is disposed in spaced relation with the forms 14 by a rectangularly shaped frame 90, which is located symmetrically along the longitudinal line 20 at one end of the forms 14. Covering the frame 90 immediately adjacent to the forms 14 is a platform 92 for receiving the concrete shaping means 40 after a columnar reinforcement C has been formed across a concrete wall panel P.

To form such a columnar reinforcement C along a concrete wall panel P, the forms 14 are positioned to enclose the casting space 12. The frame 90 and the platform 92 are erected and the reinforcing bars 16 are positioned within the forms 14. The rails 30 are secured to the forms 14 and the shaping means 40 is positioned on the rails 30 adjacent to the forms 14 farthest from the frame 90 and platform 92. An end board 96 is then secured to the forms 14 sealing one end of the U-shaped forming channel member 54, thereby preparing the shaping means 40 to receive concrete. Slits 97 are formed in the end board 96 to accommodate glulam brackets 98, which are embedded in the columnar reinforcement C and which are employed as anchors. The glulam brackets 98 are received by suitable slits in a wooden roof structural member 100 or the like that is used in the construction of a building At the opposite end of the columnar reinforcement C are concrete inserts 99. The tripod 80 is then positioned adjacent to the end of the frame 90 furthest from the forms 14 and the cable 86 is guided along its path from the winch 84 and secured to the shaping means 40. The concrete inserts can be attached to the reinforcing bars 16 by tie wires or can be inserted into the concrete before the concrete hardens.

With the apparatus 10 thus prepared, oil under pressure is then applied to the manifold 70 to activate the hydraulic cylinders 66 while concrete is deposited in the hopper 46 through the aperture 48. With the hydraulic cylinders 66 activated, the concrete shaping means 40 and the hopper 46 are agitated for ensuring a proper flow of concrete along its interior surfaces. The concrete then descends through the hopper 46 to pass through the aperture 50 into the U-shaped forming channel member 54. Within the forming channel member 54, the concrete surrounds the box shaped section 18 and adjoining portions of the reinforcing bars 16, thereby beginning the formation of a columnar reinforcement C as the pouring of a wall panel P is simultaneously commenced by placing concrete into adjoining regions of the casting space 12. In the preferred embodiment, air-entrained concrete or dry mix concrete is employed because of the curing and hardening characteristics.

As the concrete within the U-shaped forming channel member 54 sets, the shaping means 40 is advanced continuously along the casting space 12 by actuating the winch 84 at a rate suitable for forming the concrete column C. While advancing along the casting space 12, the shaping means 40 is supported on the rails 30 and guided along a rectilinear path substantially parallel to the longitudinal line 20 of the box-shaped section 18. As the vibrated shaping means 40 advances along the casting space 12, the supply of concrete poured in forming the columnar reinforcement C about the reinforcing bars 16 is continually replenished with additional concrete while additional concrete is simultaneously placed in the adjoining regions of the casting space 12. As the shaping means 40 passes beyond the forms 14 toward the tripod 80, thereby becoming positioned over the platform 92, and concrete has been poured into the casting space 12, the replenishment of concrete within the shaping means 40 is terminated as formation of a columnar reinforcement C along a concrete wall panel P has now been completed. With formation of the columnar reinforcement C thus completed, the apparatus 10 may then be disassembled and transported to another panel casting space 12.

I claim:

1. A concrete forming apparatus for forming a columnar reinforcement in a concrete wall panel comprising:

concrete shaping means with a cavity for receiving concrete and with walls adjacent the cavity for shaping the concrete to form a columnar reinforcement along a concrete wall panel, said concrete shaping means including spaced flanges projecting laterally outward within a common plane for engaging concrete in the forming of a columnar reinforcement;

support means supporting said concrete shaping means for movement above a casting space in which a concrete wall panel is formed, said support means having a narrower width than that of the casting space, said support means including a plurality of rails disposed above the casting space, said rails extending along the casting space within the width of the casting space on opposite sides of the location in which a columnar reinforcement is to be formed, said support means further including a runner on each side of said concrete shaping means advancing along one of said rails, said runners being affixed to said flanges, respectively, whereby said concrete shaping means is supported above the casting space by said rails and guided along a path along the casting space by said rails and guided along a width of the casting space to form the columnar reinforcement within the width of the casting space of the concrete wall panel; and means for advancing said concrete shaping means along the casting space for forming a columnar reinforcement along a concrete wall panel.

2. A concrete forming apparatus as claimed in claim 1 wherein said means advancing said concrete shaping means includes:

a tripod disposed outside the perimeter of the casting space in alignment with the columnar reinforcement to be formed;

a winch secured to said tripod; and a cable trained around said winch and connected to said concrete shaping means.

3. A concrete forming apparatus for forming a columnar reinforcement in a concrete wall panel comprising:

concrete shaping means for receiving concrete and shaping the concrete to form a columnar reinforcement along a concrete wall panel;

support means supporting said concrete shaping means for movement above a casting space in which a concrete wall panel is formed, said support means having a narrower width than that of the casting space, said support means including a plurality of rails disposed above the casting space, said rails extending along the casting space within the width of the casting space on opposite sides of the location in which a columnar reinforcement is to be formed, said columnar reinforcement being disposed within the width of the casting space, a runner on each side of said concrete shaping means advancing along one of said rails; and means for advancing said concrete shaping means along the casting space for forming a columnar reinforcement along a concrete wall panel within the width of the casting space forming the wall panel, said concrete shaping means including:

a hopper into which concrete is deposited, said hopper being formed with a hollow body having a larger aperture occupying the area of its upper surface and a smaller aperture occupying the area of its lower surface;

an inverted, U-shaped forming channel member with downwardly depending walls, said forming channel member depending from the hopper in fixed relation thereto and having an aperture formed through its horizontal base surface communicating with the smaller of said apertures of said hopper, whereby concrete deposited into said hopper through the larger of its apertures advances therethrough to pass form said hopper into said forming channel member through the smaller of said apertures of said hopper, a flange projecting laterally outward from the lower extremity of each of said downwardly depending walls of said forming channel member engaging concrete in the forming of a columnar reinforcement, said flanges being disposed within a common plane, said flanges projecting laterally outward are affixed to said runners, respectively, whereby said concrete shaping means is supported above the casting space by said rails within the width of the casting space and guided along a path along the casting space, and vibrating means for agitating the hopper.

* * * * *